US005615000A

United States Patent [19]

Ueda et al.

[11] Patent Number: 5,615,000

[45] Date of Patent: Mar. 25, 1997

[54] CONVEY BELT AND CONVEYING APPARATUS WITH IT

[75] Inventors: Noriyoshi Ueda, Yokohama; Naoki Toda, Tokyo, both of Japan

[73] Assignees: Canon Kabushiki Kaisha; Nitto Kogyo Co., Ltd., both of Tokyo, Japan

[21] Appl. No.: 28,133

[22] Filed: Mar. 9, 1993

[30] Foreign Application Priority Data

Mar. 11, 1992 [JP] Japan ..... 4-087906
Mar. 5, 1993 [JP] Japan ..... 5-070915

[51] Int. Cl.[6] ..... G03G 21/00

[52] U.S. Cl. ..... 399/361; 428/222

[58] Field of Search ..... 355/274, 271, 355/308–9; 428/257, 222, 224–5, 252, 265, 227, 238, 245–7, 253, 258–9; 162/348, 306, 358.2

[56] References Cited

U.S. PATENT DOCUMENTS

| | | | |
|---|---|---|---|
| 3,859,156 | 1/1975 | Yazawa et al. | 156/265 |
| 3,944,060 | 3/1976 | Hartmann | 198/193 |
| 3,973,670 | 8/1976 | Spaar | 198/193 |
| 3,983,761 | 10/1976 | Stewart | 74/231 R |
| 4,105,495 | 8/1978 | Pai | 162/348 |
| 4,481,079 | 11/1984 | Dawes | 162/348 |
| 4,552,620 | 11/1985 | Adams | 162/358 |
| 4,632,716 | 12/1986 | Smith | 156/148 |
| 4,675,229 | 6/1987 | Westhead | 428/222 |
| 4,789,009 | 12/1988 | Troughton | 139/383 A |
| 4,839,220 | 6/1989 | Stijntjes et al. | 428/258 |
| 4,857,391 | 8/1989 | Westhead | 428/222 |
| 4,877,126 | 10/1989 | van Calker et al. | 198/847 |
| 4,883,448 | 11/1989 | Kobayashi et al. | 474/260 |
| 5,178,937 | 1/1993 | Janssen et al. | 428/222 |
| 5,232,768 | 8/1993 | Eklund et al. | 428/234 |
| 5,298,124 | 3/1994 | Eklund et al. | 162/306 |

FOREIGN PATENT DOCUMENTS

| | | |
|---|---|---|
| 0367249 | 5/1990 | European Pat. Off. . |
| 57-160809 | 10/1982 | Japan . |
| 63-162742 | 10/1988 | Japan . |

*Primary Examiner*—Thu A. Dang
*Attorney, Agent, or Firm*—Fitzpatrick, Cella, Harper & Scinto

[57] ABSTRACT

The present invention provides a conveying apparatus comprising a plurality of rotary members; a frame for supporting the plurality of rotary members; and an endless belt wound around the plurality of rotary members and moved by rotation of the rotary members to convey a sheet, the belt including a core embedded within the belt and formed by weaving threads extending in a circumferential direction of the belt and threads extending in a widthwise direction of the belt; and wherein, in order to cancel a deflection force of the belt generated by the cause of distortion of the frame when the rotary members are rotated to shift the belt, each of the threads extending in the circumferential direction in the core has a constant twist direction to generate a deflection force opposite to the aforementioned deflection force.

14 Claims, 7 Drawing Sheets

S TWIST

Z TWIST

FIG. 5

| | TWIST DIRECTION | TWIST NUMBER |
|---|---|---|
| (i) | S TWIST (RIGHT) | 5 TIMES |
| (ii) | NO TWIST | 0 |
| (iii) | Z TWIST (LEFT) | 10 TIMES |

FIG. 6

| MECHANISM / WEAVE CLOTH | (a) | | (b) | | (c) | |
|---|---|---|---|---|---|---|
| | DEFLECTION FORCE | DEFLECTION DIRECTION | DEFLECTION FORCE | DEFLECTION DIRECTION | DEFLECTION FORCE | DEFLECTION DIRECTION |
| (i) | 0 | | 0.9 kg | ↰ LEFT | 2.0 kg | ↰ LEFT |
| (ii) | 1.0 kg | ↳ RIGHT | 0 | | 1.0 kg | ↰ LEFT |
| (iii) | 2.3 kg | ↳ RIGHT | 1.2 kg | ↳ RIGHT | 0.3 kg | ↳ RIGHT |

FIG. 11
| | CAUSE | DIRECTIONALITY | |
|---|---|---|---|
| | | EXIST | NO |
| MECHANISM | UNEVENESS OF SHAFT DIAMETER | ○ | |
| | UNEVENESS OF SHAFT INTERVAL A | ○ | |
| | UNEVENESS OF SHAFT INTERVAL B | | ○ |
| BELT | DIFFERENCE OF INNER PERIPHERAL LENGTH | ○ | |
| | TWIST DIRECTION OF THREAD | | ○ |
FIG. 12
A: ROLLER AXES ARE POSITIONED IN SAME PLANE BUT NOT IN PARALLEL
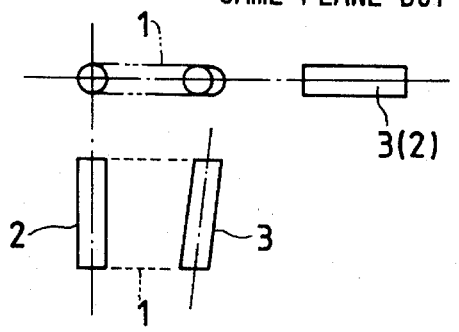
FIG. 13
B: ROLLER AXES ARE NOT POSITIONED IN SAME PLANE
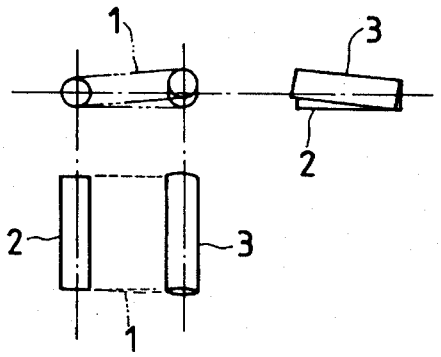

CONVEY BELT AND CONVEYING APPARATUS WITH IT

BACKGROUND OF THE INVENTION

1. Field of the Invention

The present invention relates to a belt conveying apparatus wherein a convey belt is wound around and supported by at least two rollers, and more particularly, it relates to a belt deflection adjustment technique in a belt conveying apparatus wherein a convey belt is apt to deflect in a direction perpendicular to a conveying direction at a roller supporting mechanism.

2. Related Background Art

Conventionally, for example, in automatic original (document) feeding apparatuses, an original has been fed to a predetermined position on a platen glass by using a convey belt, and, in image forming apparatuses, a convey belt has been used with a sorter for discharging sheets on which an image was formed in order and for arranging the sheets properly.

Generally, as shown in FIGS. 10A to 10C, the convey belt 1 has a core (woven cloth or web) 12 comprising peripheral lengthwise threads (weft threads) 10 and widthwise threads (warp threads) 11. A front (outer) surface of the core 12 is coated by a surface member 13 made of rubber or synthetic resin, and a back (inner) surface of the core is also coated by a surface member 15. The core 12 is formed by weaving the warps 11 and the wafts 12 alternately in an endless fashion.

When the convey belt 1 incorporating the core body therein and wound around two or more rollers is rotated, there arises a phenomenon that the belt is defected leftwardly or rightwardly. This phenomenon is caused by the defect of a mechanism portion such as unevenness of roller shaft interval and/or unevenness of roller shaft diameter, or by the defect of the belt itself such as difference between left and right peripheral-lengths of the belt and/or difference of twist of lengthwise threads (wefts) in the belt. Further, regarding the deflection of the belt, there is a case where the belt is deflected toward either side regardless of an advance direction of the belt (this case is referred to as directionality "exist") and a case where the direction of deflection of the belt is varied as the advance direction of the belt is changed (this case is referred to as directionality "no").

FIG. 11 shows a relation between the cause of the deflection of the convey belt and the directionality. In FIG. 11, when the cause of the deflection depends upon the unevenness of the shaft interval, two cases A and B can be considered.

As shown in FIG. 12, A is a case where, although axes of rollers 2, 3 are lying on the same plane, these axes are not parallel with each other; whereas, as shown in FIG. 13, B is a case where the axes of the rollers 2, 3 are not lying on the same plane. Regarding the twist direction of the thread in FIG. 11, the cause of the deflection is arisen by the twist direction of the wefts (peripheral lengthwise thread) 10 of the belt. That is, when the S-twisted thread wherein the thread is twisted rightwardly (FIG. 2A) is used, the belt is likely to be deflected leftwardly with respect to the advance direction of the belt, and, when the Z-twisted thread wherein the thread is twisted leftwardly (FIG. 2B) is used, the belt is likely to be deflected rightwardly.

In order to prevent such deflection of the belt, there have been proposed various techniques. For example, flanges were provided on both ends of each roller at the mechanism portion, or the S-twist threads and the Z-twisted threads were alternately arranged in the belt to cancel the left and right deflection forces, or, as disclosed in the Japanese Utility Model Laid-Open No. 63-162742, a deflection stopper was added to the belt.

However, if the mechanism includes the cause of the deflection of the belt, even when the belt comprising the S-twisted threads and Z-twisted threads arranged alternately is used, the belt will be deflected. If the deflection force of the belt becomes too great, the belt will often ride over the flange on the roller and the deflection stopper to deflect outwardly, and, thus, in some cases, only by using the S-twisted threads and the Z-twisted threads, the problem of the belt deflection cannot be solved. Further, although the technique that the S-twisted threads and the Z-twisted threads are used alternately permits the production of a belt which is formed by winding the threads spirally around a mold, in a seamless weaving method wherein the threads are woven in a grid pattern, it is substantially impossible to weave two kinds of threads having different weave direction alternately.

Thus, conventionally, the belt has been put to practical use by adopting the following techniques:

(1) Increasing the thickness of a belt;

(2) Increasing the resiliency of a belt by coating hard material on the belt; or (3) Providing a belt deflection preventing device.

However, with these techniques, the following problems arise.

That is to say, in order to suppress the deflection of the belt by means of the flanges secured to the roller ends, it is necessary to increase the rigidity of the belt so as to prevent the bending of the belt edge due to the reaction force of the flanges. Although the rigidity of the belt is increased by increasing the thickness of the belt or by coating the hard material on the belt, if the rigidity of the belt is great, the belt cannot follow an outer periphery of a small diameter roller adequately, and, therefore, the minimum diameter of the roller to be used with the belt becomes greater, thus limiting a range of the usable diameter of the roller. Further, in a thicker belt, there arises a difference in length between an outer peripheral surface of the belt wound around the roller and an inner peripheral surface of the same belt wound around the same roller, thereby creating difference of peripheral length, which results in difference of peripheral speed of the belt. This phenomenon has a bad influence upon not only the smooth sheet conveyance but also the service life of the belt considerably.

Further, when the exclusive belt deflection preventing device is provided, the conveying apparatus becomes more expensive and more complicated, and the smooth conveyance of the sheet is deteriorated. Furthermore, in the above techniques, since the deflection of the belt toward the either side is forcibly suppressed, if the belt having the strong deflection force is contacted with any device, the great resistance force will be generated at the contact area. Since such resistance force must be compensated for by increasing a driving force for the belt, consumption of electric power is increased. In addition, since the edge of the belt is rubbed when the belt is contacted with the belt deflection preventing device, the edge of the belt is damaged.

SUMMARY OF THE INVENTION

Accordingly, an object of the present invention is to provide a belt conveying apparatus wherein deflection direction and deflection force acting on a convey belt incorporating a core therein raised by the defect of a mechanism portion for rotatingly driving the convey belt are cancelled by creating the reverse deflection direction and deflection force, thereby solving the above-mentioned conventional drawbacks.

The present invention aims to eliminate the above-mentioned conventional drawbacks, and, a belt conveying apparatus according to the present invention comprises a mechanism portion having at least two rotatable rollers, and a convey belt having a core comprised of warp threads (or warps) extending in a peripheral direction of the belt and warps extending in a widthwise direction of the belt, which threads are wound around the rollers. Wherein, the mechanism portion supports the convey belt so that a deflection force directing to either left or right direction perpendicular to an advance direction of the belt is generated on the belt, and the wefts in the core of the convey belt are constituted by threads each having a predetermined twist direction and a constant twist number, so that a predetermined deflection force directed to either the left or right direction perpendicular to the advance direction of the belt is generated on the convey belt to cancel the deflection direction and deflection force acting on the convey belt raised by the defect of the mechanism portion.

With this arrangement, for example, the convey belt having the core and wound around the rollers rotatably mounted on two axes can be rotated and advanced between the rollers. In this case, when the mechanism portion having the rollers has the cause for deflecting the convey belt in a direction perpendicular to the advance direction of the convey belt and the cause of the deflection is such that when the advance direction of the convey belt is reversed the deflection direction of the convey belt is also reversed (that is, the deflection is such that the belt is always deflected rightwardly or leftwardly with respect to the advance direction of the convey belt (no directionality)), a belt including wefts (used to constitute the core) each having constant diameter, twist direction and twist number is used. As a result, the deflection force caused by the mechanism portion and the deflection force of the belt are cancelled with each other, with the result that, even when the mechanism position has the cause of the deflection, the convey belt can be properly advanced and rotated without any deflection phenomenon.

BRIEF DESCRIPTION OF THE DRAWINGS

FIG. 5 is a table showing specifications of wefts used in the tests;

FIG. 6 is a table showing test results;

FIG. 10A is a perspective view, partially in section, of the belt, FIG. 10B is a partial cross-sectional view of the belt, and FIG. 10C is a plan view showing a core body;

FIG. 11 is a table showing the cause of deflection and directionality due to a belt of the belt conveying apparatus;

FIG. 12 is a schematic view showing a condition of rollers generating the deflection cause A in FIG. 11; and FIG. 13 is a schematic view showing a condition of rollers generating the deflection cause B in FIG. 11.

DETAILED DESCRIPTION OF THE PREFERRED EMBODIMENTS

The present invention will now be explained with reference the accompanying drawings.

Figure 1A:
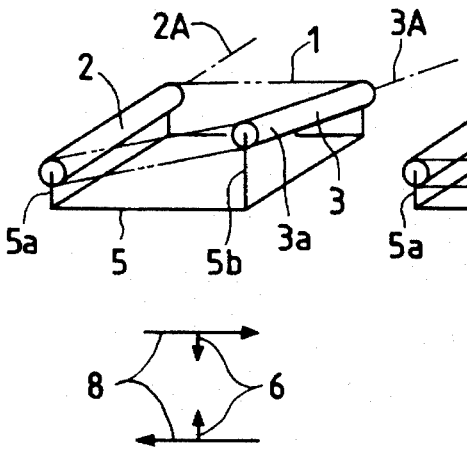
FIGS. 1A, 1B and 1C are perspective views of a mechanism portion associated with the present invention.
Figure 1B:
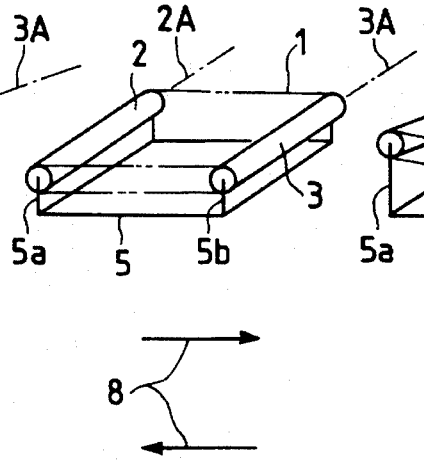
Figure 1C:
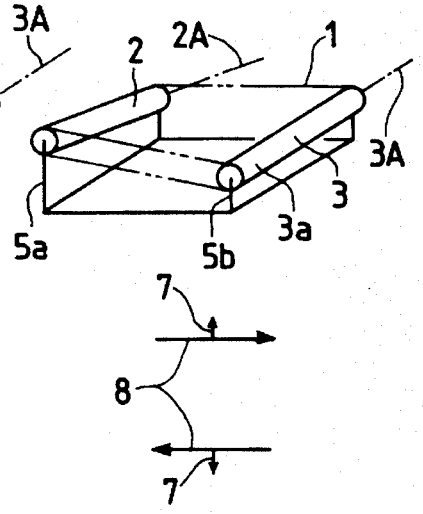

As shown in FIGS. 1A–1C, a belt conveying apparatus comprises a convey belt 1, and a mechanism portion 5 which has rollers 2, 3 around which the convey belt 1 is wound. An axis 2A of the left roller 2 and an axis 3A of the right roller 3 are rotatably supported by bearings *5a*, *5b*, respectively.

FIG. 1B shows a condition of the mechanism portion 5 that the axes 2A, 3A of the rollers 2, 3 are lying on the same plane, for example, a horizontal plane. FIG. 1A shows a condition that the right roller 3 is inclined in such a manner that a left end (this side) thereof becomes higher than a right end (that side) thereof, and FIG. 1C shows a condition that the left roller 2 is inclined in such a manner that a left end (this side) thereof becomes higher than a right end (that side) thereof. The mechanism portion 5 having the proper parallelism as shown in FIG. 1B does not generate the deflection of the belt either leftwardly or rightwardly during the advancing of the convey belt. However, the mechanism portion 5 as shown in FIG. 1A generates a deflection force tending to deflect the convey belt 1 rightwardly (shown by the arrow 6) with respect to an advance direction 8 of the convey belt; whereas, the mechanism portion 5 as shown in FIG. 1C generates a deflection force tending to deflect the convey belt 1 leftwardly (shown by the arrow 7) with respect to the advance direction 8 of the convey belt.

Figure 2A:
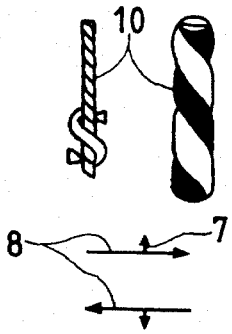
FIGS. 2A and 2B are front views showing a relation between a kind of twist and a twist direction of wefts used for constituting a core body of a convey belt according to the present invention.
Figure 2B:
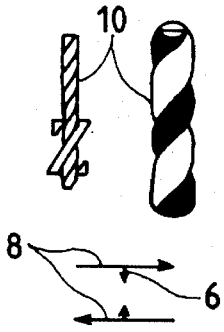
Figure 10A:
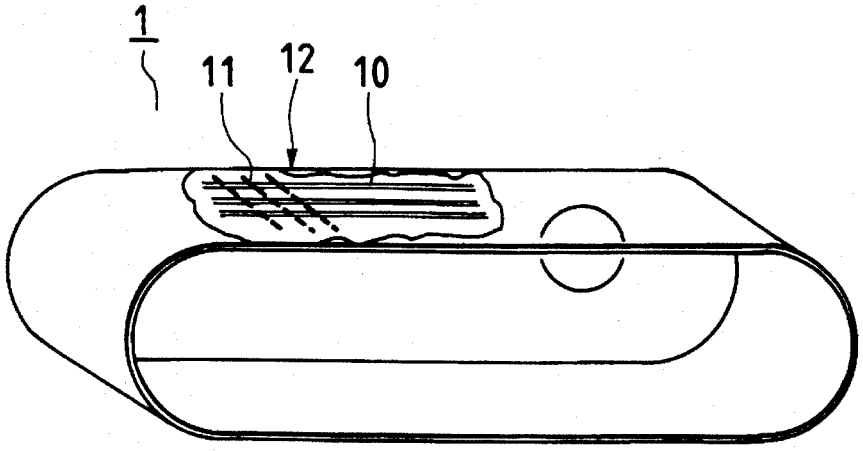
FIGS. 10A, 10B and 10C show the convey belt, where
Figure 10B:
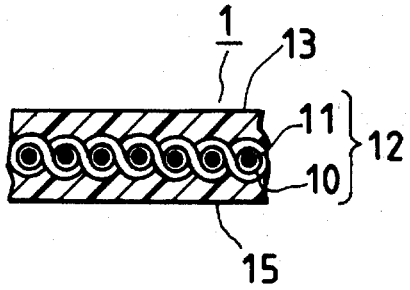
Figure 10C:
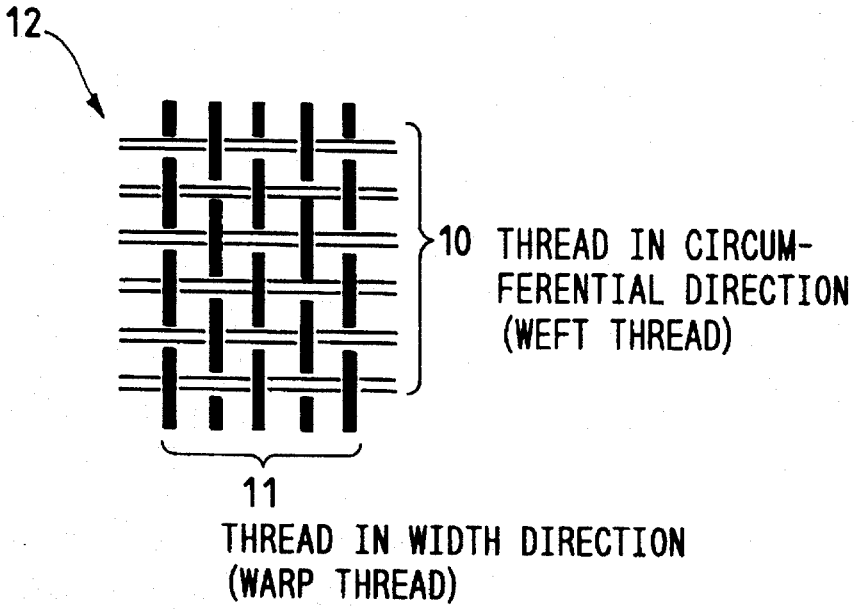

On the other hand, the convey belt 1 comprises a belt incorporating therein a core (woven cloth) as shown in FIG. 10A–10C, and wefts (peripheral lengthwise threads) 10 in the core of the convey belt 1 consist of S twisted threads or Z twisted threads as shown in FIGS. 2A or 2B. Regarding the weft of the core, as shown in FIG. 2A, the convey belt 1 having the core formed from only the S twisted threads tends to generate a deflection force 7 for always deflecting the belt leftwardly with respect to the advance direction 8 of the convey belt; whereas, as shown in FIG. 2B, the convey belt 1 having the core formed from only the X twisted threads tends to generate a deflection force 6 for always deflecting the belt rightwardly with respect to the advance direction 8 of the convey belt.

Figure 3:
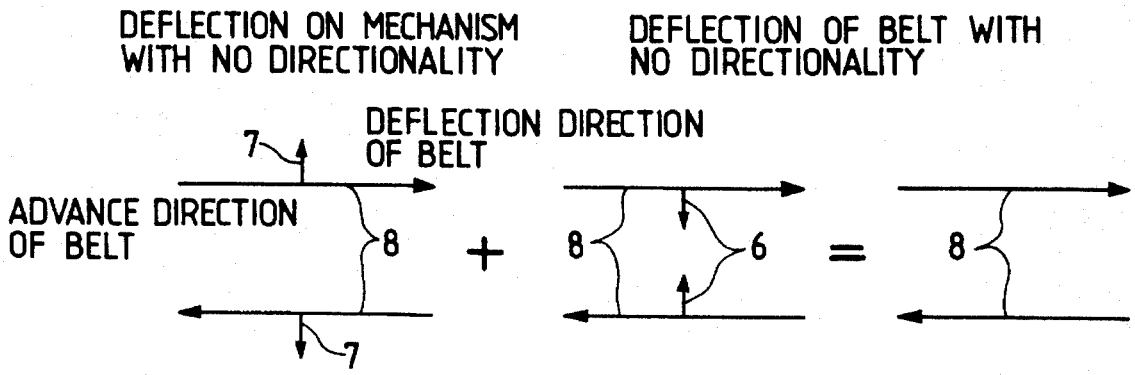
FIG. 3 is a schematic explanatory view showing a combination of the mechanism portion and the convey belt according to the present invention.

Now, for example, when the mechanism portion 5 shown in FIG. 1C and the convey belt 1 having the Z twisted threads shown in FIG. 2B are combined, as shown in FIG. 3, since the deflection direction due to the mechanism portion 5 is a direction shown by the arrow 7, and the deflection direction due to the convey belt 1 having the Z twisted threads is a direction shown by the arrow 6, the deflection force caused by the mechanism portion and the deflection force caused by the convey belt cancel each other, with the result that the convey belt 1 is rotated and advanced without any deflection. On the other hand, even when the mechanism portion 5 shown in FIG. 1A and the convey belt 1 having the S twisted threads shown in FIG. 2A are combined, the deflection forces will cancel each other, thereby reducing the deflection of the convey belt 1.

With respect to the deflection of the convey belt 1, the deflection force caused by the mechanism portion 5 is increased as the inclination of the rollers 2, 3 as shown in FIGS. 1A or 1C is increased. On the other hand, regarding the convey belt 1, the more the twist number of the wefts 10 the greater the deflection force.

Next, the test results regarding the conveying apparatus using the above-mentioned convey belt 1 will be described.

Figure 4A:
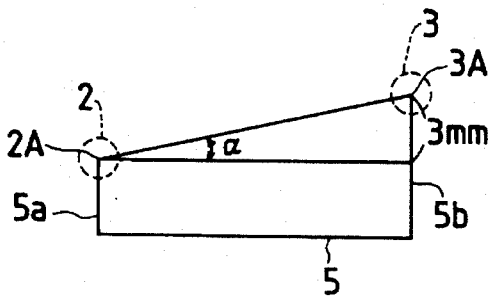
FIGS. 4A, 4B and 4C are side views of a mechanism portion used in tests according to the present invention.
Figure 4B:
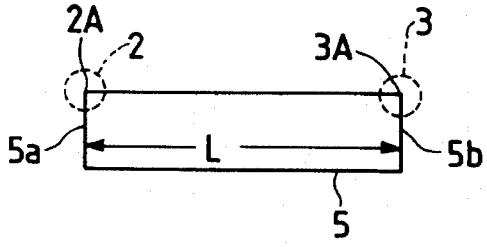
Figure 4C:
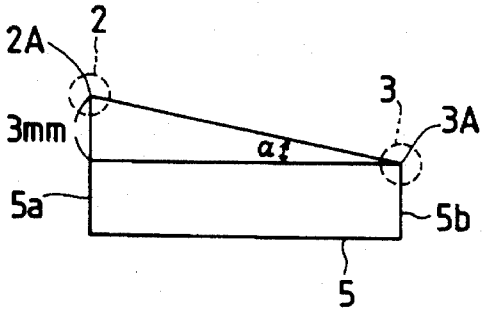

As shown in FIG. 4, in an advance testing machine using a mechanism portion 5 wherein rollers 2, 3 each having a diameter of 30 mm and a length of 320 mm were used and a shaft interval L between these rollers was set to 453 mm, FIG. 4B shows a condition that the rollers 2, 3 were arranged on a reference plane (for example, a horizontal plane), and FIG. 4A shows a condition that a left end (this side) of the axis 3A of the right roller 3 was lifted from the reference plane by 3 mm so that a twist angle α between the left ends (this side) of the rollers 2, 3 became 32', 14". Further, FIG. 4C shows a condition that a left end (this side) of the axis 2A of the left roller 2 was lifted from the reference plane by 3 mm so that a twist angle α between the left ends (this side) of the rollers 2, 3 became 32', 14".

On the other hand, the core 12 of the convey belt 1 has the warps each having No. 30/α count vinylon sewing thread, and wefts each having 250 denier polyester sewing thread, and made of polyester, and three endless tubular cores each having a peripheral length of 1 m and including wefts having different twist number and twist direction as shown in (i), (ii) and (iii) of FIG. 5 were used. Liquid polyurethane was coated on both front and back surfaces of each core to obtain convey belts each having a core and having a peripheral length of 1 m, a width of 30 cm and a thickness of 0.5 mm.

The three convey belts 1 having the features shown in FIG. 5 were incorporated into the three mechanism portions 5 as shown in FIG. 4, respectively, and a force of each convey belt acting on a flange (not shown) arranged on the roller end and the deflection direction of each belt during the advancing of the belt at a speed of 55 m/h were measured. As a result, the test results as shown in FIG. 6 could be obtained.

As apparent from FIG. 6, in the combination of the convey belt (i) using the S twisted wefts and the mechanism portion (a) having the higher left end (this side) of the right roller 3, the deflection force became zero, and, in a combination of the convey belt (iii) using the Z twisted wefts and the mechanism portion (c) having the higher left end (this side) of the left roller 2, the deflection force was little. Thus, it was found that the deflection force of the convey belt 1 and the deflection force of the mechanism portion 5 could cancel each other and a belt conveying apparatus having no deflection could be obtained by selecting, with respect to a mechanism portion 5 generating the deflection (having no directionality), wefts generating the opposite deflection (having no directionality).

Now, the present invention will be explained in connection with an embodiment wherein the present invention is applied to an automatic original feeding apparatus with reference to FIGS. 7 to 9.

Figure 7:
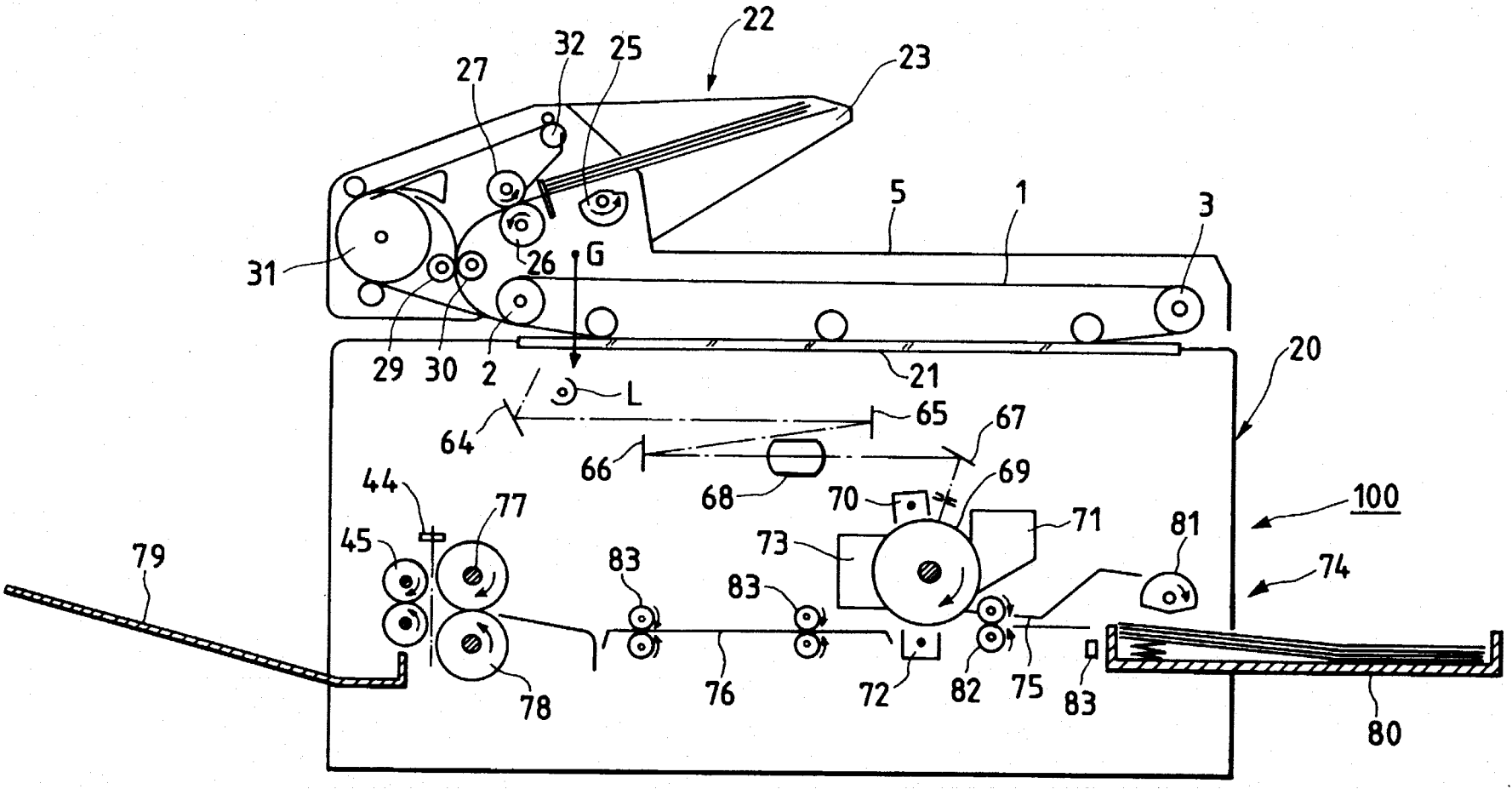
FIG. 7 is a front view of an automatic original feeding apparatus to which the present invention is applied.

In FIG. 7, a copying machine 100 has a body or frame 20 and a platen glass 21 arranged on the body. An automatic original feeding apparatus 22 is pivotally mounted on the body 20 for pivotal movement around two pivot points S1, S2 (FIGS. 8 and 9) on the body 20 to open and close a convey belt 1 with respect to the platen glass 21. The automataic original feeding apparatus has a sheet supply tray 23 on which originals to be fed are stacked, and a sheet supply roller 25 for feeding the original from the lowermost one in the original stack to separation and convey rollers 26, 27 which are rotated reversely with respect to each other to separate the originals one by one and to feed the separated original toward a pair of regist rollers 29, 30. The regist rollers 29, 30 are rotated in response to a signal from the copying machine 100 to feed the original to a predetermined position on the platen glass 21 via the convey belt 1. After an exposure operation by means of the copying machine, the original on the platen glass is returned to the original stack on the sheet supply tray 23 by the reverse rotation of the convey belt 1 and by the action of a turn roller 31 and a discharge roller 32, in response to a signal from the copying machine.

The copying machine 100 may have a conventional construction. In the illustrated embodiment, the original on the platen glass 21 is exposed by light from a light source L. The copying machine 100 has an optical system comprising reflection mirrors 64–67 and a focusing lens 68, a photosensitive drum 69, a charger 70, a developing device 71, a transfer device 72, a cleaning device 73, a sheet supply device 74, transfer sheet guides 75, 76, fixing rollers 77, 78, a pair of discharger rollers 45, a discharge tray 79, and the above-mentioned platen glass 21.

The sheet supply device 74 comprises a cassette 80 for containing transfer sheets, a sheet supply roller 81 for feeding out the sheets contained in the cassette 80, and a pair of regist rollers 82 for feeding the transfer sheet fed by the sheet supply roller to the transfer device 72 in registration with a toner image formed on the photosensitive drum 69. In the transfer device 72, the toner image is transferred onto the transfer sheet, and then the transfer sheet is fed by pairs of convey rollers 83 to the fixing rollers 77, 78, where the toner image is permanently fixed on the transfer sheet. Thereafter, the transfer sheet is discharged onto the discharge tray 79 via the discharge rollers 45.

On the other hand, as mentioned above, the original picked up from the sheet supply tray 23 by the sheet supply roller 25 is conveyed to the predetermined position on the platen glass 21 by the convey belt 1 and is stopped there. When the original is stopped at the predetermined position on the platen glass 21, an image on the original is focused on the photosensitive drum 69 by the reflection mirrors 64–67 and the focusing lens 68, thereby forming a latent image on the photosensitive drum. The photosensitive drum 69 is rotated in a direction shown by the arrow to bring the latent image to the developing device 71, where the latent image is developed image is developed as the toner image. Then, as mentioned above, the toner image is transferred onto the transfer sheet.

Figure 8:
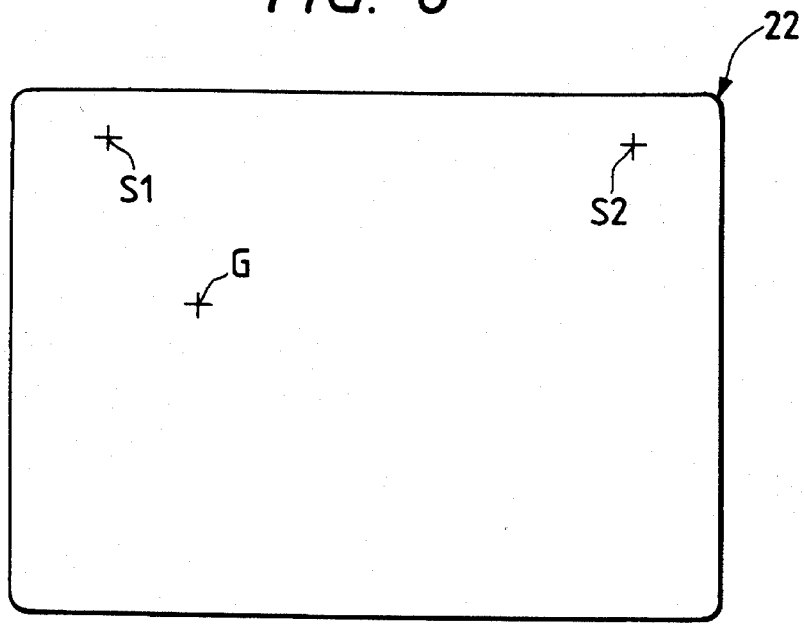
FIG. 8 is a plan view of the automatic original feeding apparatus.
Figure 9:
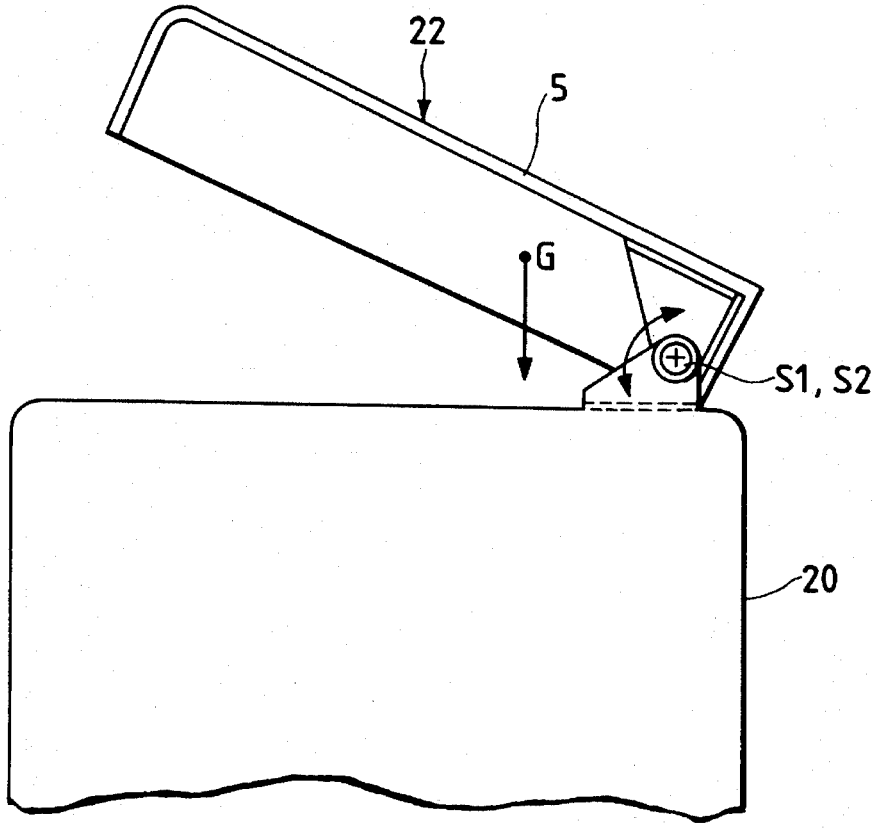
FIG. 9 is a partial side view of the automatic original feeding apparatus.

In the above-mentioned automatic original feeding apparatus 22, since the original feeding means 25–32 and the tray 23 are arranged offset from the center of the apparatus toward one side, the gravity position G of the apparatus is offset leftwardly from the middle point between the pivot points S1, S2, as shown in FIG. 8. Incidentally, counter springs (not shown) are disposed at the pivot points S1, S2 of the automatic original feeding apparatus 22 so that these springs acts to resist the gravity force thereby to cancel the whole weight of the apparatus, thus facilitating the opening and closing movement of the apparatus by an operator.

Accordingly, the whole automatic original feeding apparatus is subjected to a lifting force from the counter springs. However, since the gravity position of the apparatus is offset toward the left, the whole apparatus tends to be deformed or twisted so that the left side thereof is lowered and the right side thereof is lifted.

In this condition, within the frame of the automatic original feeding apparatus 22 which acts as a mechanism portion 5, two rollers 2, 3 are rotatably supported with a shaft interval substantially equal to the whole length of the automatic original feeding apparatus, and the convey belt 1 is wound around these rollers 2, 3. Accordingly, in the belt conveying apparatus comprising such belt and mechanism portion, the mechanism portion 5 corresponds to that shown in FIG. 1A where left end (this side) of the right roller 3 tends to be lifted upwardly with respect to the left roller 2, and, thus, the S-twisted wefts as shwon in FIG. 2A and having the twist number to generate the deflection force 7 opposite to the deflection force generated by the mechanism portion are used as the core of the convey belt 1.

Incidentally, while the above-mentioned automatic original feeding apparatus was explained as the construction having the gravity position offset to the left, if the apparatus is symmetrical with respect to the aforementioned one so that the sheet supply unit is disposed at the right side of offset the gravity position to the right, the torsional deformation of the mechanism portion will naturally be symmetrical with respect to the aforementioned one, which will correspond to FIG. 1C. Thus, in this case, the core comprising the Z-twist weft threads as shown FIG. 2B and having a predetermined twist number should be used in the convey belt 1.

Incidentally, the present invention is not limited to the aforementioned automatic original feeding apparatus, but may be similarly applied to various, apparatuses, such as a belt conveying apparatus-for a sorter.

As mentioned above, according to the present invention, since the convey belt has the core including the wefts having the selected twist direction and the selected twist number, it is possible to cancel the deflection force generated by the mechanism portion having no directionality with the deflection force generated by the convey belt, with the result that, even in an automatic original feeding apparatus including a mechanism portion having the cause of the belt deflection, a belt conveying apparatus having no deflection can be realized.

What is claimed is:

1. A sheet conveying apparatus, comprising:

a plurality of rotating members;

a frame for supporting said plurality of rotating members; and an endless belt wound around said plurality of rotating members and moved by rotation of said rotating members to convey a sheet, said endless belt including a core member made by weaving wefts extending in a moving direction of said endless belt and warps extending in a widthwise direction of said endless belt, wherein an offset of said endless belt in a widthwise direction is caused by misalignment between said rotating members, and when said endless belt is offset leftwardly on said rotating members relative to the moving direction of said endless belt an endless belt with Z-twisted wefts is selected, and when said endless belt is offset rightwardly on said rotating members relative to the moving direction of said endless belt an endless belt with S-twisted wefts is selected.

2. A sheet conveying apparatus, comprising:

a plurality of rotating members;

a frame for supporting said plurality of rotating members;

an endless belt wound around said plurality of rotating members and moved by rotation of said rotating members to convey a sheet, said endless belt including a core member made by weaving wefts extending in a moving direction of said endless belt and warps extending in a widthwise direction of said endless belt; and support means for supporting said frame, wherein an offset of said endless belt in a widthwise direction is caused by a misalignment between said rotating members due to a distortion of said frame caused by a gravity position of said supporting means and a supporting condition of said frame by said supporting means, and when said endless belt is offset leftwardly on said rotating members relative to the moving direction of said endless belt an endless belt with Z-twisted wefts is selected, and when said endless belt is offset rightwardly on said rotating members relative to the moving direction of said endless belt an endless belt with S-twisted wefts is selected.

3. A sheet conveying apparatus according to claim 1, wherein the misalignment between said rotating members is caused by shifting of at least one end of said plurality of rotating members out of a plane defined by both ends of said plurality of rotating members.

4. A sheet conveying apparatus according to claim 2, wherein said support means has biasing means for biasing said frame upwardly.

5. A sheet conveying apparatus according to claim 1, further comprising sheet supply means for feeding sheets to said endless belt.

6. A sheet conveying apparatus according to claim 5, wherein said sheet supply means is supported by said frame.

7. A sheet conveying apparatus, comprising:

a plurality of rotating members; and an endless belt wound around said plurality of rotating members, said endless belt including a core member made by weaving wefts extending in a moving direction of the belt and warps extending in a widthwise direction of said endless belt, wherein an offset of said endless belt in a widthwise direction is caused by misalignment of said rotating members, and when said endless belt is offset leftwardly on said rotating members relative to the moving direction of said endless belt an endless belt with Z-twisted wefts is selected, and when said endless belt is offset rightwardly on said rotating members relative to the moving direction of said endless belt an endless belt with S-twisted wefts is selected.

8. A sheet conveying apparatus according to claim 7, further comprising a frame for supporting said plurality of rotary members.

9. A sheet conveying apparatus according to claim 8, further comprising support means for supporting said frame.

10. A sheet conveying apparatus according to claim 8, wherein the offset of said endless belt is caused by distortion of said frame supporting said rotating members, and the misalignment between said rotating members is caused by shifting of at least one end of said plurality of rotating members out of a plane defined by both ends of said plurality of rotating members.

11. A sheet conveying apparatus, comprising:

a plurality of rotating members;

a frame for supporting said plurality of rotating members;

an endless belt wound around said plurality of rotating members and moved by rotation of said rotating members to convey a sheet, said endless belt including a core member made by weaving wefts extending in a moving direction of said endless belt and warps extending in a widthwise direction of said wefts; and image reading means for reading an image formed on the sheet conveyed by said belt, wherein when said endless belt is offset leftwardly on said rotating members relative to the moving direction of said endless belt an endless belt with Z-twisted wefts is selected, and when said endless belt is offset rightwardly on said rotating members relative to the moving direction of said endless belt an endless belt with S-twisted wefts is selected.

12. A sheet conveying apparatus, comprising:

a plurality of rotating members; and an endless belt wound around said plurality of rotating members, said endless belt including a core member made by weaving wefts extending in a moving direction of the belt and warps extending in a widthwise direction of said endless belt; and image reading means for reading an image formed on a sheet conveyed by said belt, wherein an offset of said endless belt in a widthwise direction is caused by misalignment of said rotating members because at least one end of said plurality of rotating members is out of a plane defined by both ends of said plurality of rotating members due to distortion of said frame, and when said endless belt is offset leftwardly on said rotating members relative to the moving direction of said endless belt an endless belt with Z-twisted wefts is selected, and when said endless belt is offset rightwardly on said rotating members relative to the moving direction of said endless belt an endless belt with S-twisted wefts is selected.

13. An endless sheet conveying belt, spanned between a plurality of rotating members disposed in a misalignment state, for conveying a sheet, comprising:

a core member made by weaving wefts extending in a moving direction of said endless belt and warps extending in a widthwise direction of said endless belt; and surface material layers formed on each surface of said core member, wherein when said endless belt is offset leftwardly on said rotating members relative to the moving direction of the endless belt an endless belt with Z-twisted wefts is selected, and when said endless belt is offset rightwardly on the rotating members relative to the moving direction of said endless belt an endless belt with S-twisted wefts is selected.

14. An endless sheet conveying belt, spanned between a plurality of rotating members disposed in a misalignment state, for conveying a sheet, comprising:

a core member made by weaving wefts extending in a moving direction of said belt and warps extending in a widthwise direction of said belt; and a surface material layer formed on a surface of said core member, wherein when said endless belt is offset leftwardly on said rotating members relative to the moving direction of said endless belt an endless belt with Z-twisted wefts is selected, and when said endless belt is offset rightwardly on said rotating members relative to the moving direction of said endless belt an endless belt with S-twisted wefts is selected.

* * * * *

UNITED STATES PATENT AND TRADEMARK OFFICE

CERTIFICATE OF CORRECTION

PATENT NO. : 5,615,000

DATED : March 25, 1997

INVENTOR(S) : Ueda et al.

It is certified that error appears in the above-indentified patent and that said Letters Patent is hereby corrected as shown below:

COLUMN 1:

Line 38, "peripheral-lengths" should read --peripheral lengths--.

COLUMN 6:

Line 53 "image is developed" (second occurrence) should be deleted.

COLUMN 7:

Line 36, "apparatus-for" should read --apparatus for--.

Signed and Sealed this

Eighteenth Day of November 1997

*Attest:*

*Attesting Officer*

Bruce Lehman

BRUCE LEHMAN

*Commissioner of Patents and Trademarks*